United States Patent [19]

Reicherts

[11] 4,449,338

[45] May 22, 1984

[54] TEMPORARY RESTRAINING CLAMP FOR WALLBOARD

[75] Inventor: James E. Reicherts, Cary, Ill.

[73] Assignee: United States Gypsum Company, Chicago, Ill.

[21] Appl. No.: 392,444

[22] Filed: Jun. 28, 1982

[51] Int. Cl.[3] ..... E02D 35/00

[52] U.S. Cl. ..... 52/127.8; 52/713; 52/747; 52/749; 52/768

[58] Field of Search ..... 52/749, 747, 713, 127.8, 52/127.9, 489, 768; 411/396, 383; 248/71, 300, 489

[56] References Cited

U.S. PATENT DOCUMENTS

| | | | |
|---|---|---|---|
| 1,085,277 | 1/1914 | Lund | 52/713 X |
| 2,526,827 | 10/1950 | Peters | 248/489 |
| 2,900,678 | 8/1959 | Curtis | 52/127.8 |
| 3,363,384 | 1/1968 | Rallis | 52/713 X |
| 4,187,658 | 2/1980 | Reinwall, Jr. | 52/489 |
| 4,225,108 | 9/1980 | Jaroche | 248/489 X |

*Primary Examiner*—Carl D. Friedman

*Attorney, Agent, or Firm*—Robert M. Didrick; Samuel Kurlandsky; Robert H. Robinson

[57] ABSTRACT

An integral clamp and screw in the shape of an L has a panel supporting leg and a leg from which a screw projects through and beyond the panel supporting leg. The clamp is used to support a building panel while aligning said panel over the framing members to which it is to be attached and while fastening the panel to said members. The screw is turned into a framing member, such as a ceiling joist or wall stud, by turning the clamp by hand until the panel support leg is close enough to hold the panel loosely against the member, putting the panel into place and then turning the clamp further until the supporting leg holds the panel tightly against the framing member.

6 Claims, 11 Drawing Figures

TEMPORARY RESTRAINING CLAMP FOR WALLBOARD

This invention is related to the problem of temporarily supporting a wallboard panel while it is being permanently attached to the supporting members of a wall or ceiling of a building. More particularly, it relates to a clamp which is adapted to be screwed into a supporting member along a line adjacent to the periphery of a panel to be attached to said supporting member. Still more particularly, it relates to a clamp having a screw integrated in its body so that it is a one-piece device which may be screwed into and out of a ceiling joist or wall stud easily by hand.

The problem of holding a plaster board or other large building panel up against the ceiling joists before and during nailing of the panel is one that builders and handymen have attempted to overcome in various ways—like having an assistant hold the panel by pressing upward with his hands or jerry-rigging an assembly of lumber into a platform connected to an upright pole or building elaborate scaffolding which may be rolled into position and jacked up to raise the panel into place.

Thus, there is a continuing need for a simple device which may be temporarily attached to a joist or a stud around the area to be paneled, removed after the paneling is attached and used again repeatedly.

It is an object of this invention to provide an integral clamp and screw by the use of which a ceiling panel may be mounted by one person.

It is another object of this invention to provide a method for the installation of a building panel on a ceiling or wall by one person.

The clamp and the method of using it are illustrated by the drawings and the description thereof which follows.

Figure 1:
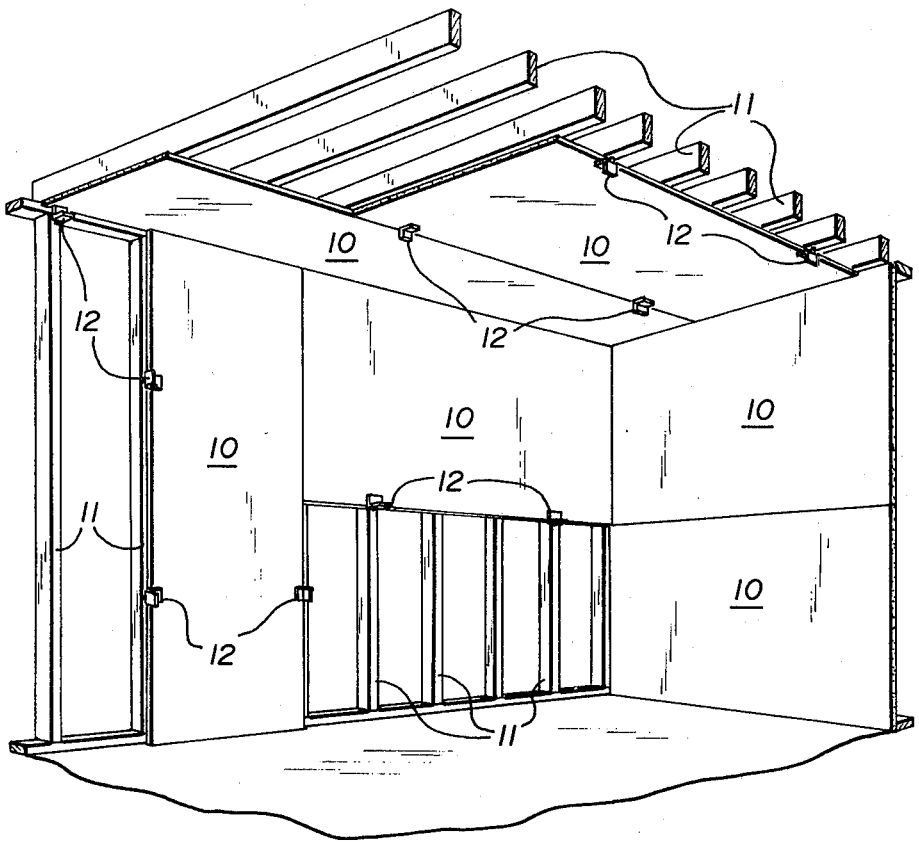
FIG. 1 is a perspective view of a room in which a ceiling panel and a wallboard are temporarily supported prior to being fastened to the joists and studs which frame said room.
Figure 2:
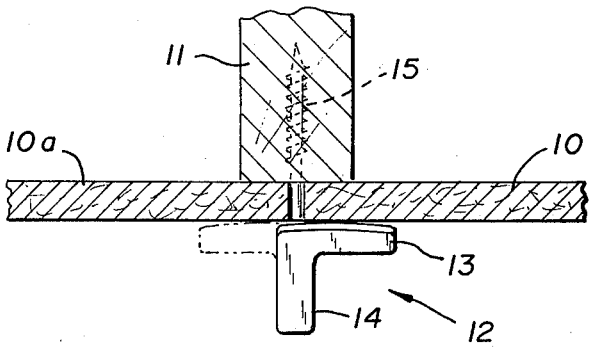
FIG. 2 is an elevational view, partly in section, showing the temporary support of a ceiling panel against a joist by the clamp of this invention.

In FIG. 1, building panels 10 are held against framing members 11 by the clamps 12, one of which is shown in more detail in FIG. 2 in which clamp 12 is shown in place after having been screwed into framing member 11 and turned from its position (shown by dotted lines) before panel 10 is raised to bear against member 11. A second panel 10*a* is shown as it would be placed against member 11 after panel 10 is permanently attached to member 11. The clamp 12 may be turned from its position under panel 10 to a supporting position under panel 10*a* prior to nailing panel 10*a* to the member 11.

Also in FIG. 1, clamp 12 is shown as it would be used during the installation of a vertically mounted wall panel and as it would be used to support a ceiling panel while said panel is being installed at the intersection of wall and ceiling framing members 11. A vertically mounted wall panel is one which is mounted so that its length is vertically oriented.

Figure 3:
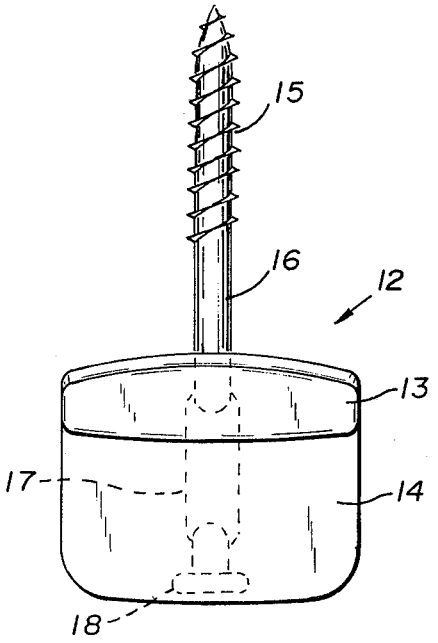
FIG. 3 is an elevational view of the clamp of this invention.
Figure 4:
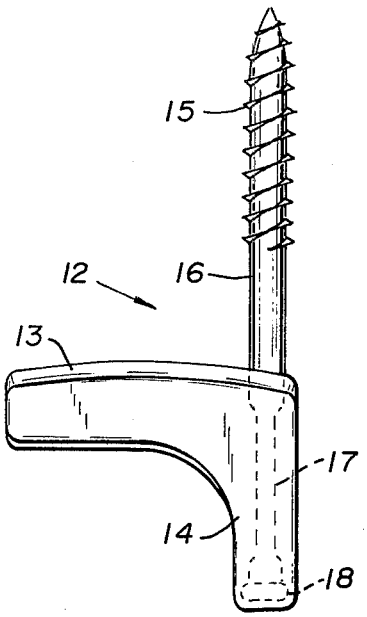
FIG. 4 is a side elevational view of the clamp of FIG. 3.

FIG. 3 shows the broad interior faces of the L-shaped clamp 12, leg 13 of which is adapted for contact with the panel 10, and leg 14 of which is integral with the screw 15. Said screw 15 has a shank portion 16 which, in turn has a flattened segment 17, shown by the dotted lines in FIGS. 3 and 4, which may have an oval cross-section as shown in FIGS. 5–8 or a rectangular cross-section. The screw 15 is integrated with the leg 14 by means of a technique known as insert molding. Other means for inserting the screw 15 into the leg 14 will be readily apparent to those skilled in the art. For example, the leg 14 may be fabricated so that the cavity into which the screw 15 is inserted is a longitudinal channel having a rectangular cross-section so that a rectangular shank segment 17 is prevented from twisting within the leg 14 when the clamp 12 is screwed into a joist or stud.

Figure 5:
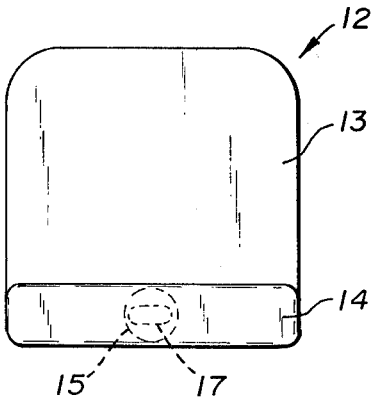
FIG. 5 is a plan view of the clamp of FIG. 3.

As mentioned, FIG. 5 shows by hidden lines the oval cross-section of the flattened segment 17 of the shank 16 of screw 15.

Figure 6:
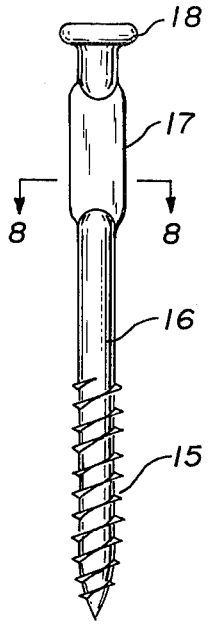
FIG. 6 is an elevational view of a screw which is an integral part of the clamp of FIG. 3.
Figure 7:
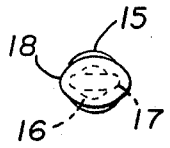
FIG. 7 is a plan view of the screw of FIG. 6.
Figure 8:
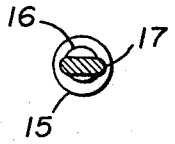
FIG. 8 is a sectional view of the screw of FIG. 6 taken along line 8—8.
Figure 9:
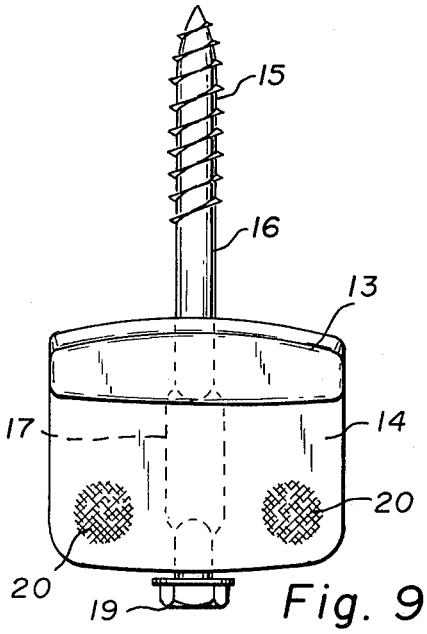
FIG. 9 is an elevational view of another embodiment of the clamp of this invention.
Figure 10:
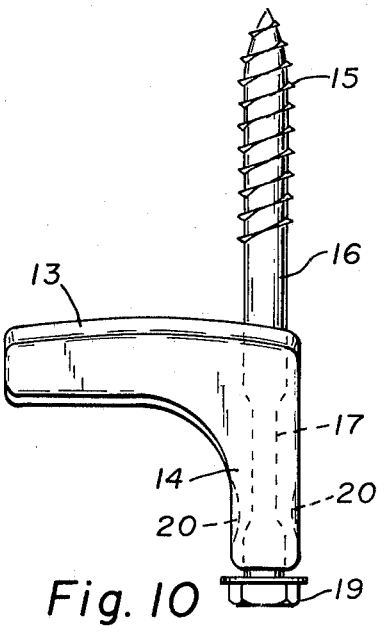
FIG. 10 is a side elevational view of the clamp of FIG. 9.

FIGS. 6–8 show the screw 15 as it appears before fabrication of the clamp 12. As shown there, the head 18 of screw 15 has an oval shape; in the alternative embodiment of the clamp 12 shown in FIGS. 9 and 10, the screw 15 has a hexagonal head 19 exterior to the leg 14 of clamp 12. The knurled depressions 20 on opposite faces of the leg 14 serve as thumb and finger holds when the clamp 12 is being screwed into the framing member 11.

Figure 11:
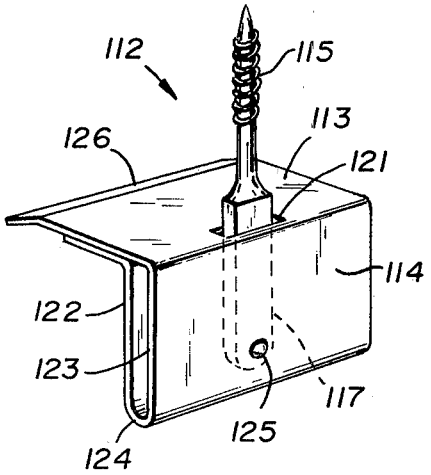
FIG. 11 is a perspective view of another embodiment of the clamp of this invention.

In FIG. 11, the clamp 112 is made from a piece of sheet metal. The panel contacting leg 113 has a slot 121 which communicates with the space between the walls 122 and 123 of the leg 114. Walls 122 and 123 are connected by a bottom wall 24. The screw 115 is mounted between the walls 122 and 123 by means of a rivet 125 passing through the shank segment 117 and both of said walls 122 and 123. The leg 113 is bent at an oblique angle to form a flange 126 and is thus adapted to slide over the surface of a building panel without damaging it. Stability may be imparted to the clamp 112 by spot-welding leg 113 to the horizontal extension of the wall 122.

When installing a panel 10 during the process of forming a wall or ceiling in a room, it is convenient to scribe an outline of a panel 10 on the framing members 11 to which the panel is to be attached. A sufficient number of the clamps 12 are then screwed into a framing member adjacent to but outside of the outline of each panel edge to support the panel temporarily. The clamps 12 are preferably spaced apart so that support will be provided at least every 4 feet along the panel to be attached. It is convenient to drill pilot holes about ¼" away from the guidelines which form the outline of the panel. The clamps 12 are then screwed into the pilot holes until the panel contacting leg 13 is approximately twice the thickness of the panel away from the framing member 11 and said leg is substantially perpendicular to the guideline. A lesser or greater distance may be desirable. The panel 10 is then placed into position against the framing members 11 and the clamps are screwed further until the leg 13 is in contact with the panel 10. If not yet aligned with the guidelines, the panel is moved until the edges coincide with the outline scribed for that purpose. The clamps are then screwed in until the legs 13 hold the panel securely against the framing members. An important advantage of this invention is realized in the next step; a ceiling panel is readily fastened by nailing the center portion first and then proceeding toward the edges.

Additional panels are attached in a similar manner except that when the diameter of the shank 16 of the screw 15 is so large that spacing between the panel edges would be too great for practical purposes if a second panel 10 were butted up against the shank of a clamp already in place, it is preferred to drill pilot holes through the panel in place about ¼" in from the edge.

When a ceiling panel is to be installed at the intersection of the wall and ceiling as illustrated in FIG. 1, the clamp 12 is screwed into a stud so that the screw 15 and the leg 14 are parallel to the plane of the ceiling joists. The clamp 12 is placed at a distance below the ceiling joists which is sufficient to allow the leg 13 to rotate from a vertically downward position to a position at which the distal end of leg 13 presses the ceiling panel against a joist. Thus, the outer face of the leg 14 is the initial support for the ceiling panel but after all of the clamps 12 have been placed, the clamps which have been screwed into the stud are turned so that the distal end of the leg 13 of each such clamp contacts the panel and holds it up while the panel is being fastened to the joists by nails or the appropriate wallboard screws.

The installation of a large, heavy ceiling panel by one person is made practical by this invention by the following procedure. After the required number of clamps are in place along the perimeter of the area to be covered, the clamps along one edge of the area are turned so that the supporting legs cross over the guideline and into the area. The panel is lifted and the corresponding edge of the panel is guided onto said supporting legs along that edge. The panel is thus partially supported along one edge while the opposite edge is pushed against the joists and the remaining clamps are turned into the supporting position.

In order to protect the surface of the panels being installed, it is preferable that the contacting surface of the legs 13 be chamfered to present a beveled edge to the panel surface and avoid gouging if the clamp 12 is screwed in at an angle from the perpendicular.

The clamp body may be made of metal or plastic, such as polyethylene or polystyrene or nylon. The body may be a molded solid or it may be made from sheet metal.

Various embodiments of the invention thus illustrated and described may be suggested thereby to one skilled in the art but still be within the spirit and scope of the appended claims.

Having thus described the invention, I claim:

1. A clamp adapted for the temporary support of a building panel during installation, said clamp comprising an L-shaped body, one leg being adapted for contact with said panel, and a screw projecting from the other leg of the L through and beyond the panel contacting leg and perpendicular to said panel contacting leg.

2. The clamp of claim 1 wherein said other leg has a longitudinal channel within its body which extends to the surface of the panel contacting leg and the shank of the screw is nested within said channel so that twisting of the shank within the channel is prevented.

3. The clamp of claim 1 wherein the body of said other leg is hollow, being comprised of two spaced apart walls and a connecting wall which is distal to said panel contacting leg and the surface of the panel contacting leg has a slot open to the space between said walls, and the shank of said screw is mounted between said spaced apart walls to project through and abut said slot.

4. The clamp of claim 1 wherein said other leg has a cavity having a rectangular cross-section, said cavity communicating with a hole in the surface of the panel contacting leg, and said screw has a shank which rests in an abutting relationship within said cavity.

5. A clamp adapted for the temporary support of a building panel during installation, said clamp comprising an L-shaped body having a horizontal leg and a vertical leg, and a screw integral with and vertically coplanar with said vertical leg and projecting away from said vertical leg through and beyond the surface of the horizontal leg, whereby said clamp, upon inversion of the L shape, is adapted for the support of a ceiling panel, and, upon rotation of the L shape through 90° about the intersection of the two legs, it is adapted for the support of a wall panel.

6. A method for the installation of a building panel on the framing members of a room, said method comprising;

scribing guidelines on said members to form an outline of said panel;

placing a sufficient number of clamps adjacent to said guidelines but spaced away from the area enclosed by said guidelines to support said panel, each clamp comprising an L-shaped body, one leg of which is adapted to contact said panel and support it, and the other leg of which is integral with a screw which projects from it through, beyond, and perpendicular to the panel contacting leg;

said placement of the clamps being accomplished by inserting the point of the screw into a framing member so that the shank of the screw is substantially perpendicular to said member, and turning the clamp about the longitudinal axis of the screw to cause said screw to advance further into said framing member until the distance between the panel contacting leg and the framing member is about twice the thickness of the panel to be installed and the panel contacting leg is pointed away from the area enclosed by the outline in a direction substantially perpendicular to the guideline adjacent to the clamp;

placing the panel against the framing members to be covered;

further turning each clamp to place the panel contacting leg thereof in contact with the panel;

aligning the panel edges with the guidelines which form the outline of the area to be covered and further turning each clamp to draw the panel contacting leg snugly against the panel while the panel is held in alignment against a framing member; and fastening said panel to the framing members.

* * * * *